US005851067A

United States Patent [19]

Fleischli et al.

[11] Patent Number: 5,851,067

[45] Date of Patent: Dec. 22, 1998

[54] STATIC MIXER WITH A BUNDLE OF CHAMBERED STRINGS

[75] Inventors: Markus Fleischli; Rolf Heusser; Felix Streiff, all of Winterthur, Switzerland

[73] Assignee: Sulzer Chemtech AG, Winterthur, Switzerland

[21] Appl. No.: 871,317

[22] Filed: Jun. 9, 1997

[30] Foreign Application Priority Data

Jul. 5, 1996 [EP] European Pat. Off. ..... 96810441

[51] Int. Cl.[6] ..... B01F 5/06

[52] U.S. Cl. ..... 366/337

[58] Field of Search ..... 366/181.5, 336, 366/337, 340; 138/37, 39, 40, 42; 48/189.4

[56] References Cited

U.S. PATENT DOCUMENTS

| | | | |
|---|---|---|---|
| 3,051,453 | 8/1962 | Sluijters | 366/337 |
| 3,195,865 | 7/1965 | Harder . | |
| 3,239,197 | 3/1966 | Tollar | 366/337 |
| 3,328,003 | 6/1967 | Chisholm | 366/337 |
| 3,406,947 | 10/1968 | Harder . | |
| 3,620,506 | 11/1971 | So . | |
| 3,893,654 | 7/1975 | Miura . | |
| 3,928,199 | 12/1975 | Kirk et al. | 366/336 X |
| 4,040,256 | 8/1977 | Bosche et al. | 366/337 X |

FOREIGN PATENT DOCUMENTS 0 163 217 12/1985 European Pat. Off. .

OTHER PUBLICATIONS

Patent Abstracts of Japan, vol. 5, No. 16 (C–041), Jan. 30, 1981 & JP–A–55 145522 (Toray Ind.Inc.), Nov. 13, 1980, Abstract.

*Primary Examiner*—Charles E. Cooley
*Attorney, Agent, or Firm*—Townsend and Townsend and Crew LLP

[57] ABSTRACT

The static mixer contains a bundle of chambered strings (A, B, . . . ) which at least partly comprise mixing-active chambers (A1, A2, . . . ). The bundle is arranged in a tube. The mixing-active chambers extend in the direction of the tube in each case between two closed ends. Two mutually adjacent side walls of the mixing-active chambers contain four alternately disposed passages which produce connections to two chambers lying upstream and downstream. Re-layering chambers are arranged between at least two sections of the mixer which contain mixing-active chambers, each of which has two closed ends and three lateral passages to adjacent chambers. The re-layering chambers occur in pairs, with a direct or an indirect connection being provided via one of the passages in each case.

15 Claims, 5 Drawing Sheets

Fig.1
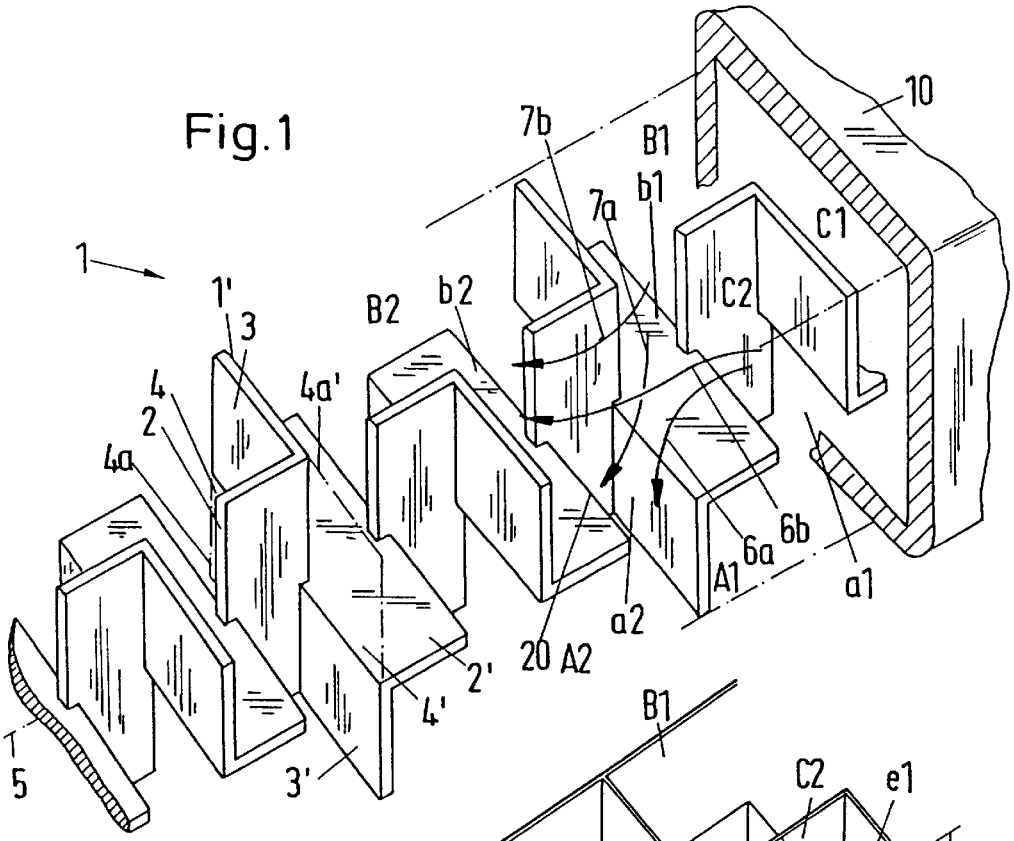
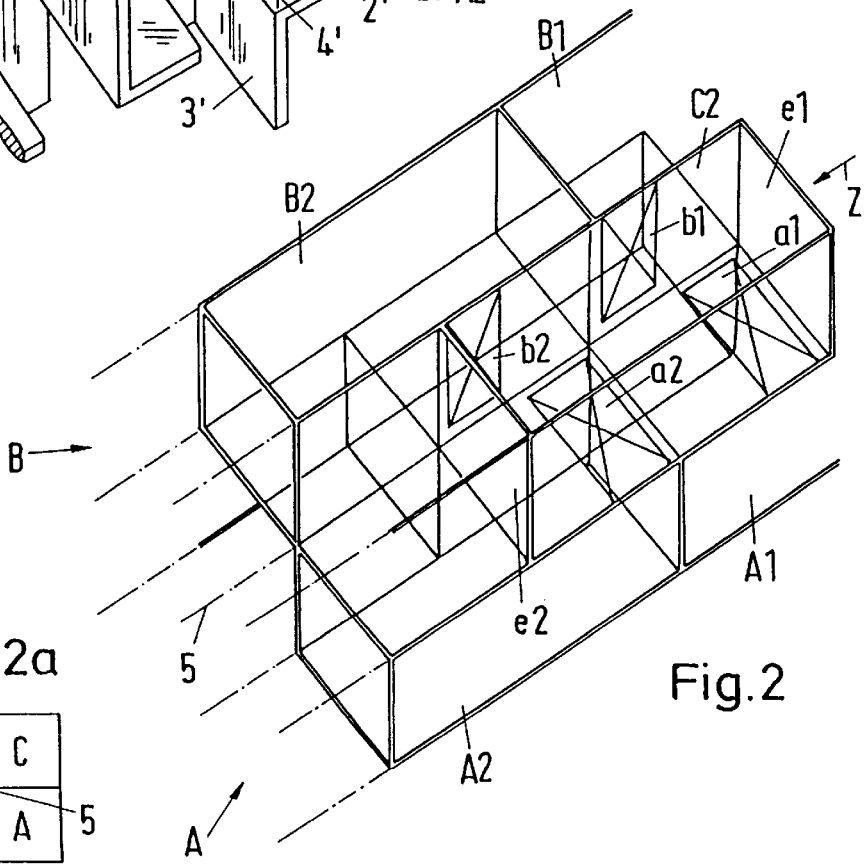
Fig.2
Fig.2a
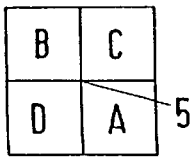

Fig. 10
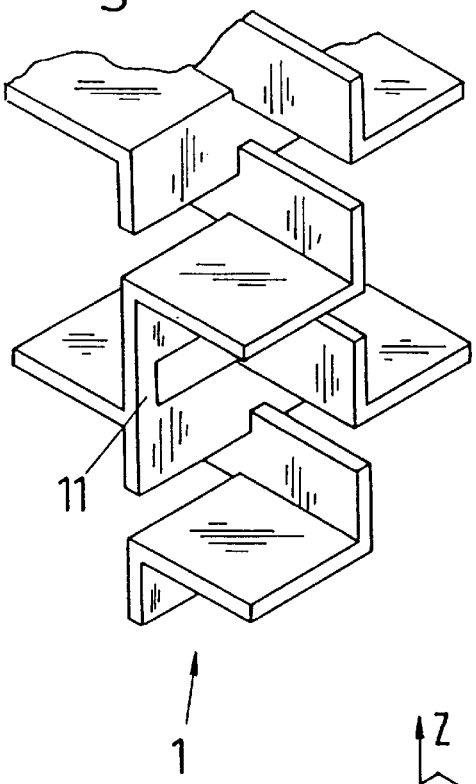
Fig. 11
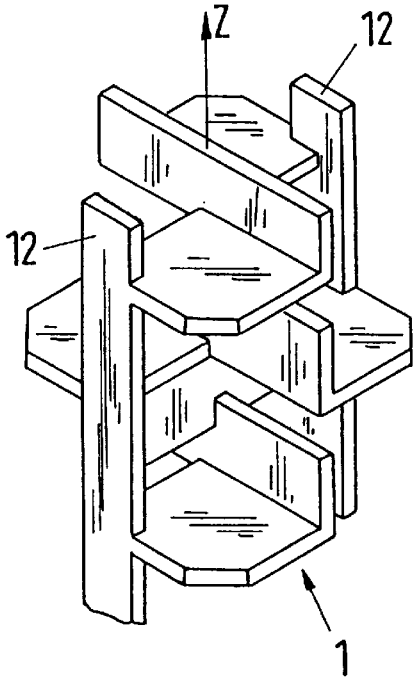
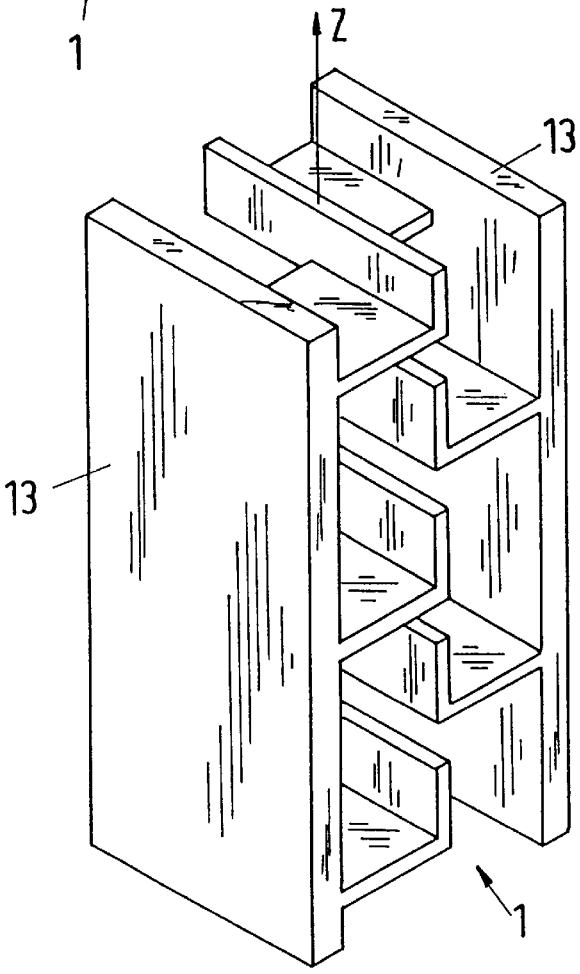
Fig. 12

STATIC MIXER WITH A BUNDLE OF CHAMBERED STRINGS

BACKGROUND OF THE INVENTION

The invention relates to a static mixer with a bundle of chambered strings or lines.

A mixer of this kind is described in U.S. application Ser. No. 08/660,434. It works in accordance with a principle similar to that of the known Multiflux and ISG mixers; however, substantially less material is required for its manufacture. A mixer of this kind, which is advantageously used for mixing highly viscous media, consists of a tube and a plurality of mixing elements arranged in this tube. Each of the mixing elements comprises two axial sections, with at least one separating or partition flange being associated with each section, which subdivides that section. The separating flanges of the two sections cross one another and subdivide the tube cross-section into subsurfaces which are substantially of equal size. Both open subsurfaces as well as subsurfaces covered with deflection plates are provided at the boundary between the sections, and indeed in such a manner that exactly one open subsurface is present on both sides of each separating flange. With respect to mixing elements following one another, the following relations hold: on the one hand, adjacent separating flanges cross one another, and on the other hand, the open subsurfaces are arranged so as to be mutually displaced.

In exemplary embodiments described in the named U.S. application Ser. No. 08/660,424 a mixing-active chamber in accordance with the alternative definition is associated with an open subsurface. The two closed chamber ends and the adjacent side walls, which contain passages to further chambers, are formed by the deflection plates and/or the separating flanges.

The sets of static mixers given by the two definitions are not identical. There are however subsets of these sets for which both definitions apply to their mixers. The named exemplary embodiments are elements of the subsets.

Multiflux mixers contain a linear arrangement of mixing elements, each of which has two channels. Each of these channels narrows continuously in the direction of flow up to the middle of the mixing element (confusor); after the narrowest point it then diverges continuously (diffusor), and indeed in a plane rotated by 90°. A medium flowing through the mixing element experiences a re-forming, through which the number of partial layers doubles. This re-forming is composed of a "cutting" of the medium into two partial flows at the entry into the mixing element, a "compression" (in the confusor), an "expansion" (in the diffusor) as well as the bringing together of the partial flows. In the ideal case, the "cutting" takes place in such a manner that in each case a flow with a uniform layering is cut perpendicularly to the layers so that after the re-forming, a uniform layering—with twice the number of partial layers—is present.

A corresponding re-forming of the medium to be treated takes place in the mixing-active chambers of the mixers, without however the need for confusors and diffusors for this re-forming.

In the mixing of two media having different values for the viscosity, deviations from the ideal mechanism are observed. After passing a number of mixing elements, the partial layers that lie at the boundary of the layering are substantially thicker than the rest of the partial layers.

SUMMARY OF THE INVENTION

The object of the invention is to provide a mixer in which deviations from the ideal mixing effect are at least partially eliminated. This object is satisfied in that "re-layering chambers" (or turnover chambers) are provided in the mixer through which partial layers standing at the boundaries are relocated into the interior of the layering.

BRIEF DESCRIPTION OF THE DRAWINGS

FIG. 1 is a perspective view of a section of a mixer structure which has only mixing-active chambers, FIG. 2 is a perspective view of the geometrical construction of the mixer structure of FIG. 1, FIG. 2*a* is a cross-section through the structure of FIG. 2, FIG. 10 is a perspective view of a mixer structure with an additional, advantageous, structure element, FIG. 11 is a perspective view of a first laterally reinforced mixer structure, FIG. 12 is a perspective view of a second mixer structure with lateral reinforcement.

DESCRIPTION OF THE PREFERRED EMBODIMENTS

Figure 3:
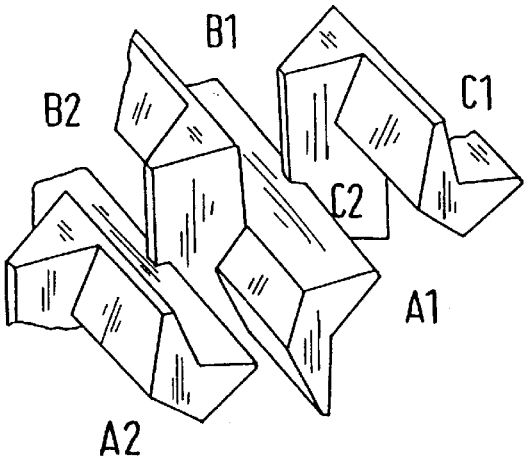
FIG. 3 shows a first modification of the mixer structure shown in FIG. 1.

The static mixer shown in FIG. 1 comprises a mixer structure 1 which is arranged in a tube 10. The mixer structure 1 is composed of mixing elements 1', each of which consists of two separating flanges 2, 2' and two deflection plates 3, 3'. In the plane of the deflection plates 3, 3', there are two open subsurfaces 4, 4', which have also been designated as passage holes.

The geometrical construction of the mixer structure 1—see FIGS. 2 and 2*a*—can be described as a pack or bundle of chambered strings A, B, C and D oriented in the direction of the z-axis. The designations of the chambers are A1, A2, . . . B1, B2 . . . C1, C2, . . . and D1, D2, . . . These chambers are "mixing-active"; they each extend in the direction of the tube 10 between two closed ends e1, e2; and two mutually adjacent side walls of the mixing-active chambers contain four passages a1, b1, a2 and b2 (each with a surface marked with a cross in FIG. 2) of alternating disposition. The chamber C2 is connected via the passages a1 and b1 to the two chambers A1, B1 lying upstream as well as via the passages a2 and b2 to the two chambers A2, B2 lying downstream. All the chambers in the mixer of FIG. 1 are mixing-active. In general, however, a mixing-active chamber can also be connected to other chambers (re-layering or intermediate chambers, see further below).

The strings A and B—seen as cross-sections in FIG. 2*a*—have the same construction; string A can be brought to coincidence with string B by a 180° rotation about the z-axis (or the centerline 5). The same relationship exists between the strings C and D. The strings of a pair A, B are connected to the respective strings of the other pair C, D via the chamber passages a1, . . . The two string pairs differ in that the chambers of the one pair are arranged so as to be displaced in the z-direction by half a chamber length with respect to those of the other pair.

How the medium to be mixed is re-directed or reformed in the chamber C2 is indicated by the arrows 6*a*, 6*b*, 7*a* and 7*b* in FIG. 1. Two medium flows emerge from the strings A and B through the entry passages a1 (arrows 6*a*, 6*b*) and b1 (arrows 7*a*, 7*b*) into the chamber C2 and thus into the string C, unite there and influence each other in their movement through the chamber C2. At the edge 20 near the passage exit a2 a first separation off of a first partial flow (arrows 6*a*, 7*a*) takes place, which passes over into string A. The remaining partial flow (arrows 6*b*, 7*b*) enters into the string B via the exit passage b2. In the ideal case there is a uniform distribution, as indicated by the arrows, with each arrow corresponding to the same amount of transported mixing material.

The chambers of the mixer structure 1 are substantially in the shape of a rectangular prism and the passages are rectangular. The walls are executed in the shape of plates. The walls need not have constant wall thicknesses, however; they can for example be executed with a wedge shape as illustrated in FIG. 3.

Figure 4:
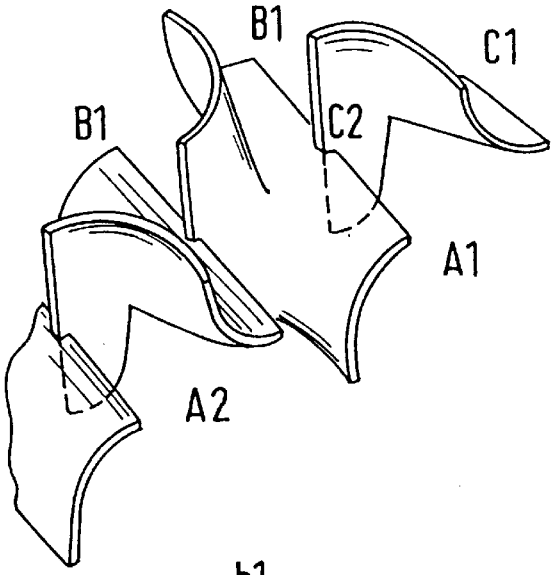
FIG. 4 shows a second modification of the mixer structure shown in FIG. 1.

Curved shapes can also be used for the walls, as is illustrated in FIG. 4, in order that the pressure drop in the mixing material produced by the mixer structure be smaller than that with the mixer structure of FIG. 1.

Figure 5:
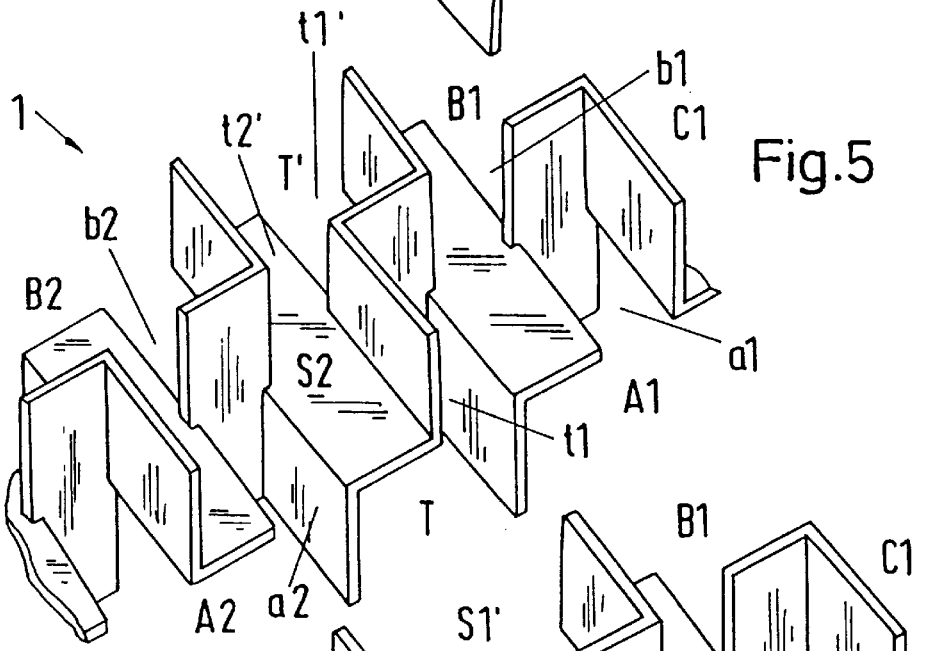
FIG. 5 is a perspective view of a first mixer structure in accordance with the invention with re-layering chambers.

In additional to the mixing-active chambers the mixer structure 1 contains "re-layering chambers" S1, S2 in accordance with the invention—see FIG. 5—and S1', S2' (not visible in FIG. 5). The chamber S1 has two entry passages a1 and b1 as well as an exit passage t1. The passage t1 forms the connection to an intermediate chamber T (or transfer chamber) which has only one entry, namely the passage t1, and one exit t2 (not visible). A corresponding intermediate chamber T' with an entry t1' and an exit t2' is arranged diametrically with respect to T. The intermediate chambers T and T' lead further to re-layering chambers S2' (not visible) and S2 respectively, each of which contains one entry passage and two exit passages. For S2 these passages are the passages designated by t2' and a2 and b2 respectively. The chambers S1 and S2' and the chambers S1' and S2 each form a pair connected by a transfer chamber T, T' respectively. In these chamber pairs a re-layering of the layers takes place which leads to the improvement of the mixing quality in accordance with the invention. A further mixing step takes place at the same time in the second re-layering chamber S2, S2'.

Figure 6:
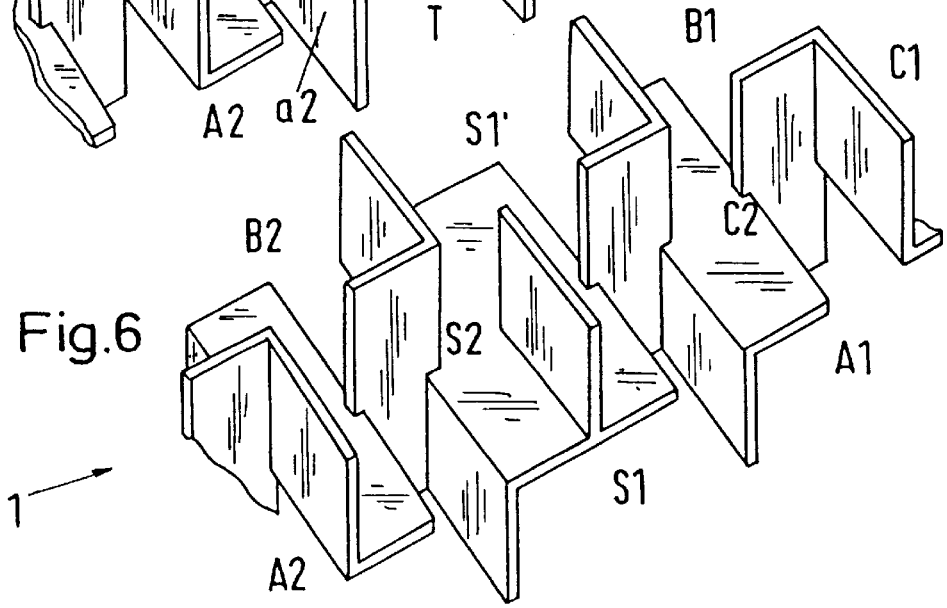
FIG. 6 is a perspective view of a second mixer structure in accordance with the invention with re-layering chambers.
Figure 7:
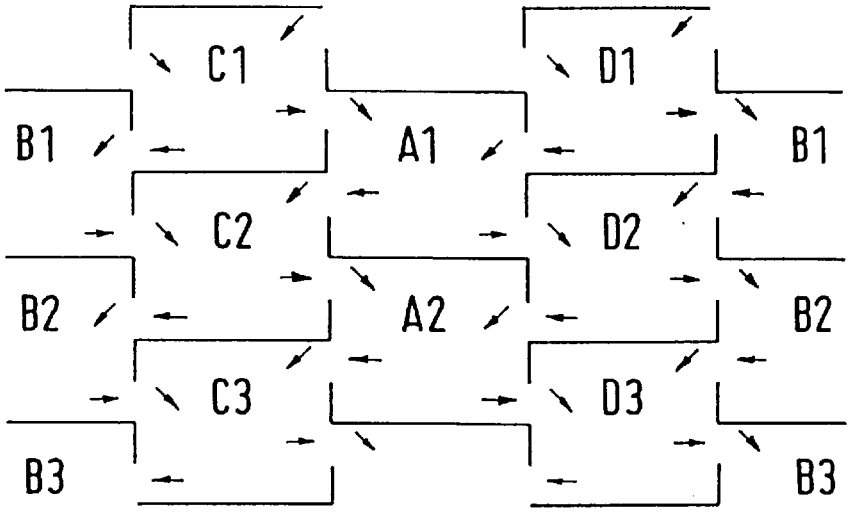
FIG. 7 is an unwrapped view into a plane of the edges lying at the periphery of the mixer structure in accordance with FIG. 1.
Figure 8:
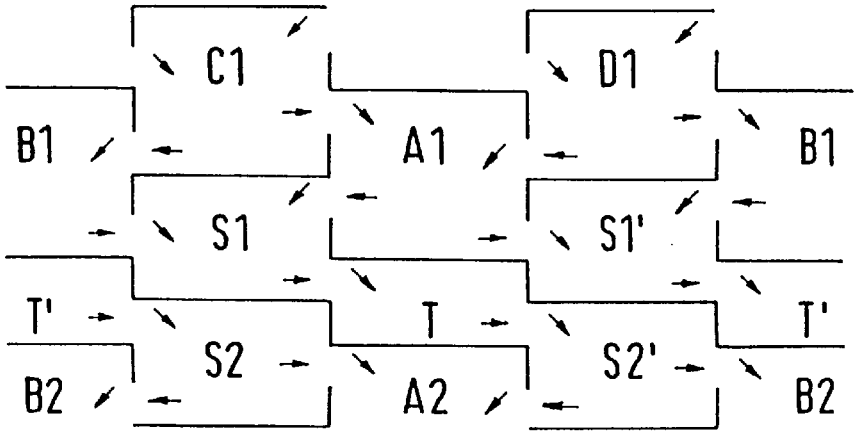
FIG. 8 is a corresponding unwrapped view for a mixer structure in accordance with FIG. 5.
Figure 9:
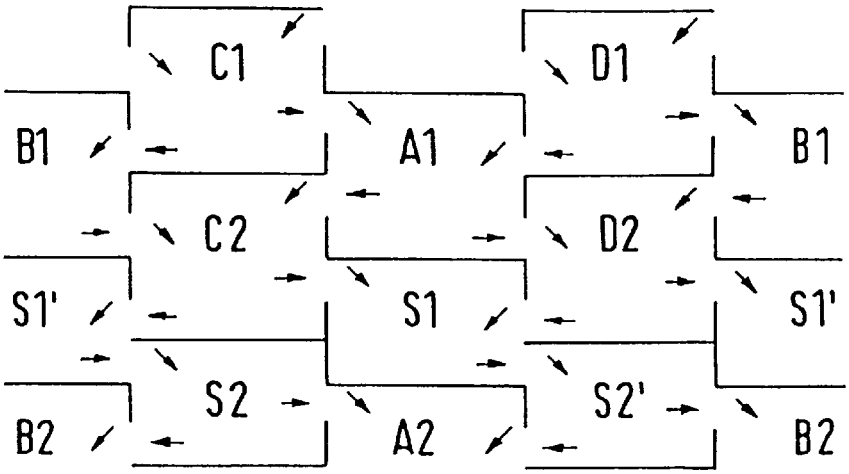
FIG. 9 is an unwrapped view for a mixer structure in accordance with FIG. 6.

FIG. 6 shows a second embodiment of the mixer structure in accordance with the invention in which re-layering chambers S1, S2' and S1', S2, which are present pairwise, are directly adjacent. From the oblique views of FIGS. 1, 5 and 6 the interconnection of the individual chambers is difficult to see or cannot be seen in its entirety. This interconnection can readily be made recognizable by unwrapping the mixer structures 1 along their extent into a plane. Such unwrappings are shown in FIGS. 7 to 9. The two lateral margins, which extend parallel to the z-axis, are respectively formed by the string B with the chambers B1, B2, B3, . . . in FIG. 7, by B1, T', B2, . . . in FIG. 8 and by B1, S1', B2, . . . in FIG. 9.

The meander-like lines in FIGS. 7 to 9 represent the outer wall edges of the mixer structures 1. The outer corners of the deflection plates 3, 3' (FIG. 1) are not marked; they each lie in the middle of the horizontal stretches of the meander-like lines. The flow of the mixing material is indicated by arrows: inclined arrows at the entry points of the chambers, horizontal arrows at the exit points. In FIG. 7 (cf. FIG. 1) all chambers are equivalent; they are mixing-active chambers. In FIG. 8 the chamber arrangements S1-T-S2' and S1'-T'-S2 are particularly noteworthy (cf. FIG. 5). In FIG. 9 the chamber arrangements S1-S2' and S1'-S2 are particularly noteworthy (cf. FIG. 5).

FIG. 10 shows a further means with which a contribution towards satisfying the object of the invention can be made. It is as follows: most of the passages between adjacent mixing-active chambers are laterally bounded by the tube 10; for directing the flow, some individual passages are each bounded by a rib 11 arranged at the tube 10. Mixing material that flows along the tube wall is deflected into the interior of the tube 10 by these ribs 11. The mixing quality is thereby improved.

Since, as a rule, highly viscous media are treated by the mixer in accordance with the invention, large pressure gradients arise in the direction of the z-axis of the mixer structure 1. These pressure gradients decrease when the wall thicknesses are made smaller. If the walls of the mixer structure 1 are thin, however, there is the danger that the structure will be crushed. The mixer structure 1 can be brought into a more stable form with suitable reinforcement means. FIGS. 11 and 12 show reinforcements by strips 12 and 13 which are arranged at the periphery of the mixer structure 1 in the z-direction. Such reinforcements can naturally also be provided for mixer structures which contain no re-layering chambers in accordance with the invention.

FIGS. 1 to 12 relate to mixers whose mixing-active chambers are arranged in four strings. A mixer of this kind corresponds to the first exemplary embodiment which is described in the named U.S. application Ser. No. 08/660,434; it is shown again in FIG. 13 in the schematic form of representation chosen there. The two other exemplary embodiments are shown in FIGS. 14 and 15.

Figure 13:
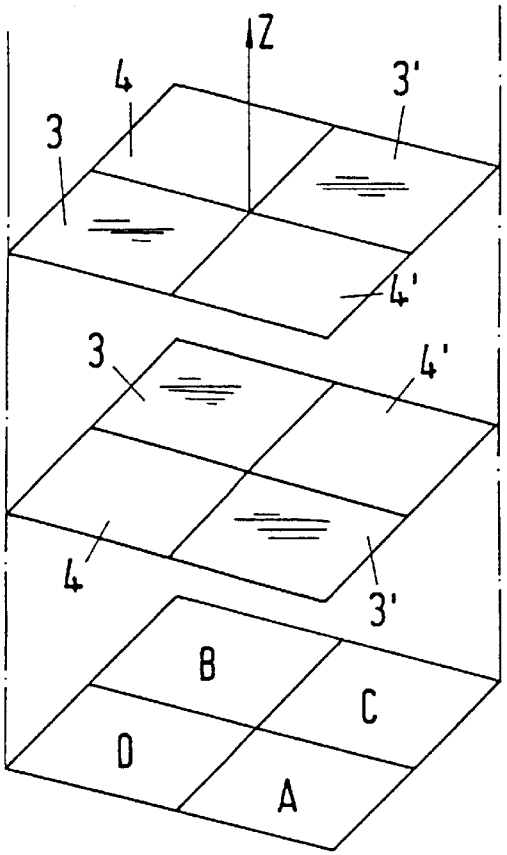
FIG. 13 is a schematic representation of a mixer structure with a bundle of four chambered strings.

In FIG. 13 the two upper planes represent the boundaries between adjacent axial sections which have the mixing elements. Each of them has two open subsurfaces as well as two subsurfaces covered by deflection plates 3, 3'; and the open subsurfaces 4, 4' are arranged to be mutually displaced. The lower plane specifies the designations A, B, C and D of the four chambered strings. Corresponding remarks hold for the mixers of FIGS. 14 and 15.

Figure 14:
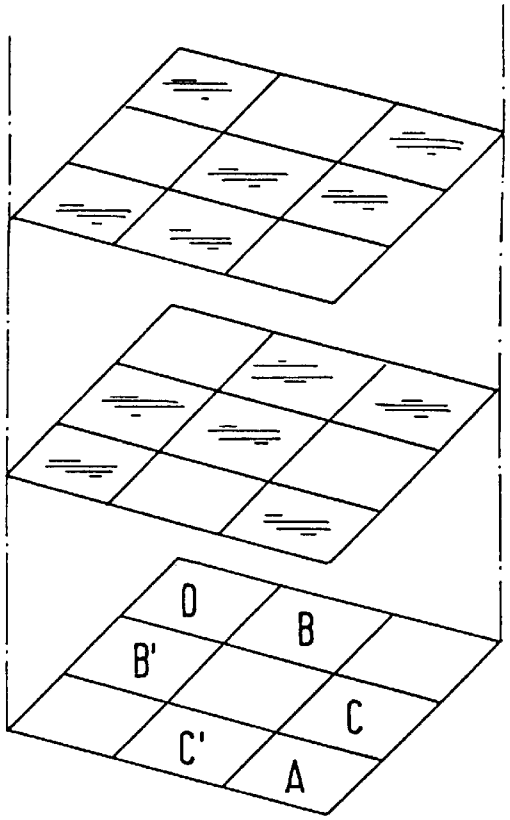
FIG. 14 is a schematic representation of a mixer structure with nine chambered strings.

Mixers in accordance with FIG. 14 contain bundles with nine strings arranged in the direction of the tube, with six of these strings, namely A, C, B, D, B' and C', comprising mixing-active chambers and the remaining three strings, which are not designated, containing intermediate chambers which produce indirect connections between mixing-active chambers. The intermediate chambers arranged in the corner strings each have—like the above named transfer chambers T and T'—two passages to adjacent chambers. The intermediate chambers of the central string each contain four such passages, which are arranged in ring shape.

Figure 15:
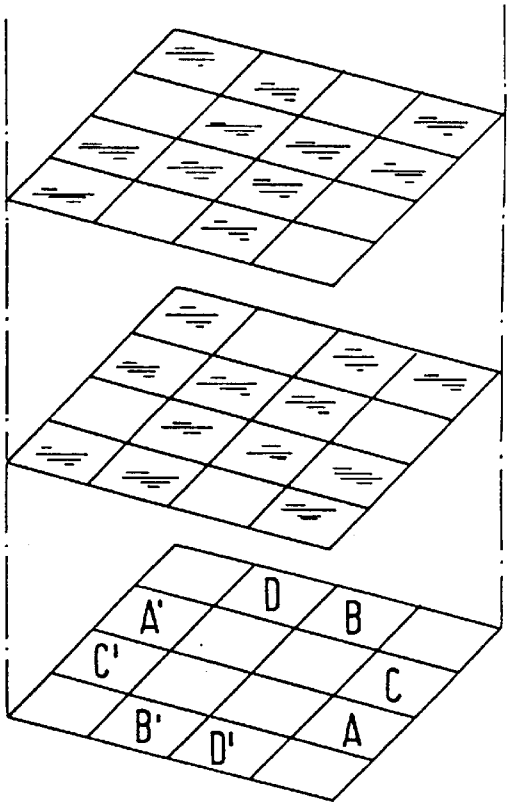
FIG. 15 is a schematic representation of a mixer structure with sixteen chambered strings.

Mixers in accordance with FIG. 15 contain bundles with sixteen strings arranged in the direction of the tube, with eight of these strings, namely A, C, B, D, A', B', C' and D', comprising mixing-active chambers and the remaining eight strings containing intermediate chambers which produce indirect connections between mixing-active chambers. The intermediate chambers again each have two or four passages to adjacent chambers as in the embodiment of FIG. 14.

What is claimed is:

1. A static mixer comprising:

a bundle of chambered strings arranged in a tube and oriented in a direction of the tube, the chambered strings comprising a plurality of chambers each extending in the direction of the tube between two closed ends, the plurality of chambers including a plurality of mixing-active chambers and a plurality of re-layering chambers, each mixing-active chamber including first and second mutually adjacent side walls having four alternately disposed passages each providing communication with one of first and second neighboring mixing-active chambers downstream thereof and first and second neighboring mixing-active chambers upstream thereof, the plurality of mixing-active chambers being arranged into at least two sections spaced along the direction of the tube by the re-layering chambers, the re-layering chambers each having first, second and third lateral passages providing communication with neighboring chambers.

2. The mixer of claim 1 wherein the re-layering chambers are arranged in pairs which are connected by one of the first, second and third lateral passages of each re-layering chamber.

3. The mixer of claim 2 wherein each pair of the re-layering chambers are directly connected.

4. The mixer of claim 2 wherein the plurality of chambers further include intermediate chambers having first and second lateral passages and each pair of the re-layering chambers are indirectly connected by one of the intermediate chambers.

5. The mixer of claim 1 wherein the bundle has four chambered strings.

6. The mixer of claim 1 wherein the mixing-active chambers are substantially formed alike.

7. The mixer of claim 1 wherein the mixing-active chambers connected by the passages between adjacent chambered strings are so arranged as to be displaced by half a chamber length in the direction of the tube with respect to one another.

8. The mixer of claim 1 wherein the bundle has nine chambered strings, only eight of the nine chambered strings comprise mixing-active chambers, and one remaining chambered string comprises intermediate chambers which provide indirect connections between the mixing-active chambers.

9. The mixer of claim 1 wherein some of the plurality of chambers of the chambered strings include at least one passage partially bounded by a rib for deflecting a flow through the passage.

10. The mixer of claim 1 wherein the plurality of chambers of the chambered strings have substantially a form of rectangular prisms.

11. The mixer of claim 1 wherein the plurality of chambers of the chambered strings have passages which are substantially rectangular.

12. The mixer of claim 1 wherein the chambered strings include walls separating adjacent chambers with the passages of the adjacent chambers formed through the walls, each wall having a relatively small thickness so that a square of the wall thickness is substantially smaller than an area of one of the passages through the wall.

13. The mixer of claim 12 wherein the bundle of chambered strings is formed by injection molding.

14. The mixer of claim 1 wherein the bundle of chambered strings is reinforced by strips which are arranged at a periphery of the bundle in the direction of the tube.

15. The mixer of claim 1 wherein the bundle of chambered strings is in the form of a monolithic structure.

* * * * *